US009829276B2

(12) United States Patent
Laemmlen

(10) Patent No.: US 9,829,276 B2
(45) Date of Patent: Nov. 28, 2017

(54) WEAPON HOLSTER DEVICE

(71) Applicant: StealthGearUSA, LLC, American Fork, UT (US)

(72) Inventor: Paul Laemmlen, Cedar Hills, UT (US)

(73) Assignee: StealthGearUSA LLC, American Fork, UT (US)

( * ) Notice: Subject to any disclaimer, the term of this patent is extended or adjusted under 35 U.S.C. 154(b) by 0 days.

(21) Appl. No.: 14/741,310

(22) Filed: Jun. 16, 2015

(65) Prior Publication Data

US 2016/0370143 A1 Dec. 22, 2016

(51) Int. Cl.
*F41C 33/02* (2006.01)
*F41C 33/04* (2006.01)

(52) U.S. Cl.
CPC ..... *F41C 33/048* (2013.01)

(58) Field of Classification Search
CPC F41C 33/02; F41C 33/041; A45F 2200/0591; Y10S 224/911–224/912
USPC ..... 224/192–193, 587, 243, 238, 911–912
See application file for complete search history.

(56) References Cited

U.S. PATENT DOCUMENTS 7,314,152 B1 * 1/2008 Garrett ..... F41C 33/0236 224/192
2005/0184115 A1 8/2005 Wells
2014/0027486 A1 * 1/2014 McGee ..... F41C 33/02 224/587
2014/0158733 A1 * 6/2014 McDonnell ..... F41C 33/048 224/587
2015/0034683 A1 * 2/2015 Tedder ..... A45F 5/00 224/242
2015/0034684 A1 2/2015 Tedder
2015/0115005 A1 * 4/2015 Slinkard ..... F41C 33/043 224/243
2016/0102940 A1 * 4/2016 Sykes ..... F41C 33/0236 224/587

OTHER PUBLICATIONS

International Search Report and Written Opinion dated Sep. 9, 2016 for PCT Patent application No. PCT/US2016/037445.
Notice of Allowance dated Oct. 3, 2016 for Design U.S. Appl. No. 29/527,881.

* cited by examiner

*Primary Examiner* — Justin Larson
*Assistant Examiner* — Phillip Schmidt
(74) *Attorney, Agent, or Firm* — The Mueller Law Office, P.C.

(57) ABSTRACT

A holster device is disclosed that can conform or contour a body part or article of clothing to which the holster device is secured to. In addition, the holster device can include wings that are attached to a shell, with the wings being configured to flex by way of flexible and/or compressible spacers that are secured between the wings and shell of the holster device.

11 Claims, 8 Drawing Sheets

WEAPON HOLSTER DEVICE

TECHNICAL FIELD

The subject matter described herein relates to a holster device that can secure a weapon and conform to a body part or article of clothing.

BACKGROUND

Weapon holsters can be configured to hold various types of weapons, such as guns. In addition, weapon holsters can protect and restrict movement of the weapons and can be secured to various parts of the body and/or articles of clothing. Some people who carry weapons in weapon holsters want to do so inconspicuously, such as undercover police officers. As such, these people also want weapon holsters that not only safely carry a weapon, but also effectively conceal them.

SUMMARY

Aspects of the current subject matter can include a holster device that can conform or contour a body part or article of clothing to which the holster device is secured to. In addition, the holster device can include wings that are attached to a shell, with the wings being configured to flex by way of flexible and/or compressible spacers that are secured between the wings and shell of the holster device.

In one aspect, a gun holster device can include a shell that is shaped to cover a part of a first side of a gun and a backing that is secured to the shell thereby forming a pocket between the shell and the backing. The pocket can be configured to secure the gun to the holster. The gun holster device can also include a first wing attached to and extending from a first end of the shell. In addition, the gun holster device can include at least one spacer positioned between the first wing and the first end of the shell, with the at least one spacer including a flexible or compressible material that allows the first wing to flex relative to the shell.

In some variations one or more of the following features can optionally be included in any feasible combination. The shell can include a rigid material and the backing can be shaped to extend a length along a second side of the gun, with the second side being opposite the first side. A second wing can be attached to and extend from a second end of the shell, with the first end and the second end being on opposite sides of the shell. One or more spacers of the at least one spacer can be positioned between the second wing and the second end of the shell. A first top edge of the first wing can be aligned with a second top edge of the second wing. At least one of the first wing and the second wing includes a rigid material. The gun holster device can further include a holster attachment feature configured to secure the gun holster device to at least one of a body part and an article of clothing. The holster attachment feature can be releasably secured to the first wing such that a position of the holster attachment feature relative to the first wing is adjustable. The holster attachment feature can include at least one of a clip and a closed loop. The backing can include at least one of a padded material and a breathable material.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

The current subject matter is directed to a holster device that can secure a weapon, such as a gun, to a body part or article of clothing. In addition, the holster device can conform or contour (i.e., fit closely to) the body part or article of clothing the holster device is secured to. The holster device disclosed herein can allow a user to safely, securely, and inconspicuously carry a weapon. For example, the ability of the holster device to conform to a body part or clothing of a user can allow the user to carry the weapon in the holster device in a concealed manner. This can prevent others from knowing that the user is carrying the weapon. The ability of the holster device to contour or conform to an adjacent body part or clothing of a user can also improve the comfort and effectiveness of the holster device (e.g., the user's ability to safely and efficiently withdraw the weapon).

FIGS. 1-7 illustrate an implementation of a holster device 100 that includes a shell 102 coupled to a backing 104. The shell 102 can be shaped to cover a part of a first side of a weapon, such as a gun. The backing 104 can be shaped to cover a part of a second side of the weapon. The shell 102 and backing 104 can be coupled together to form a pocket 106 therebetween. For example, the shell 102, backing 104, and pocket 106 can be configured to safely secure a gun within the pocket 106.

Figure 1:
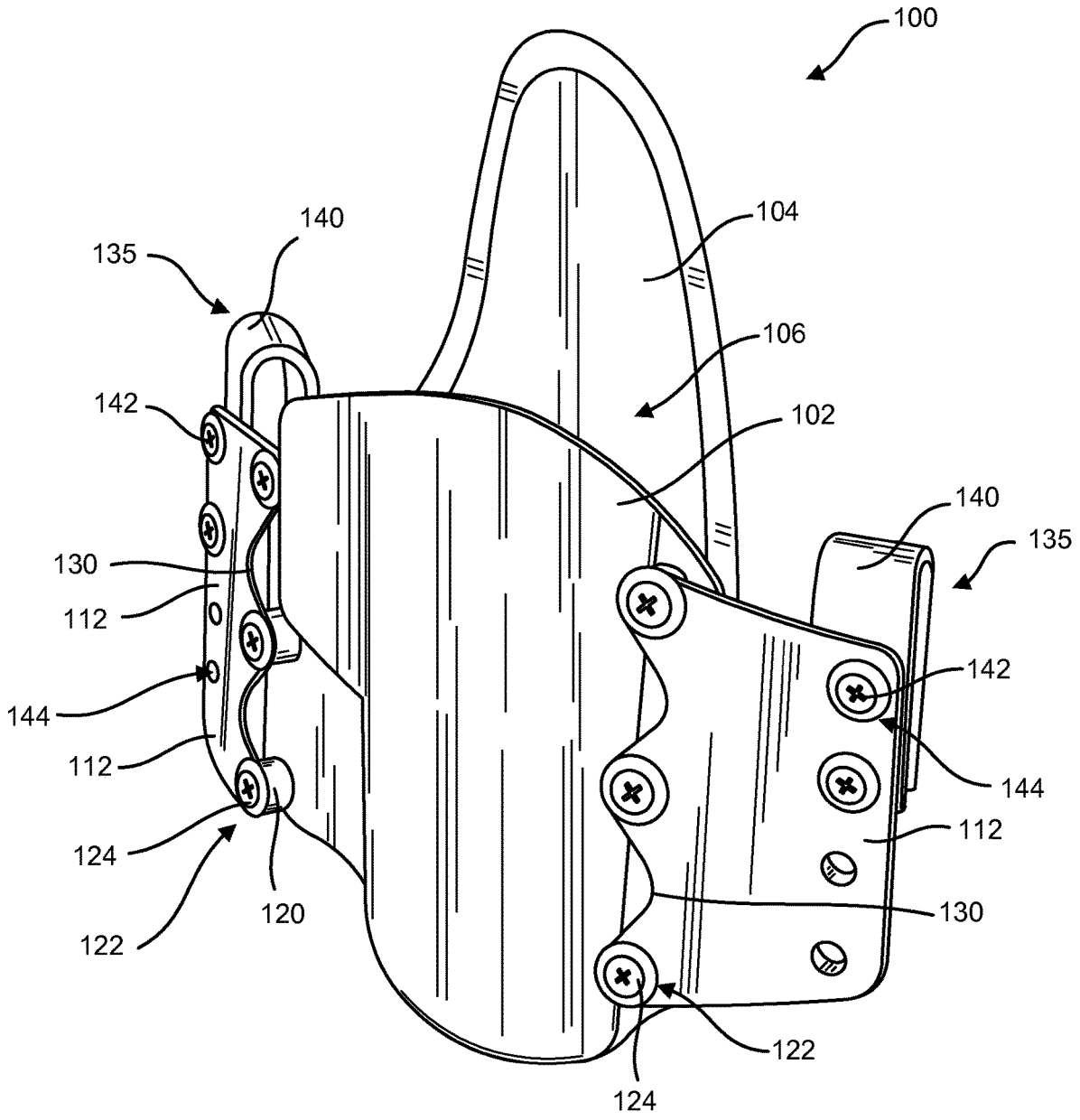
FIG. 1 shows a perspective view of an implementation of a holster device consistent with implementations of the current subject matter.
Figure 2:
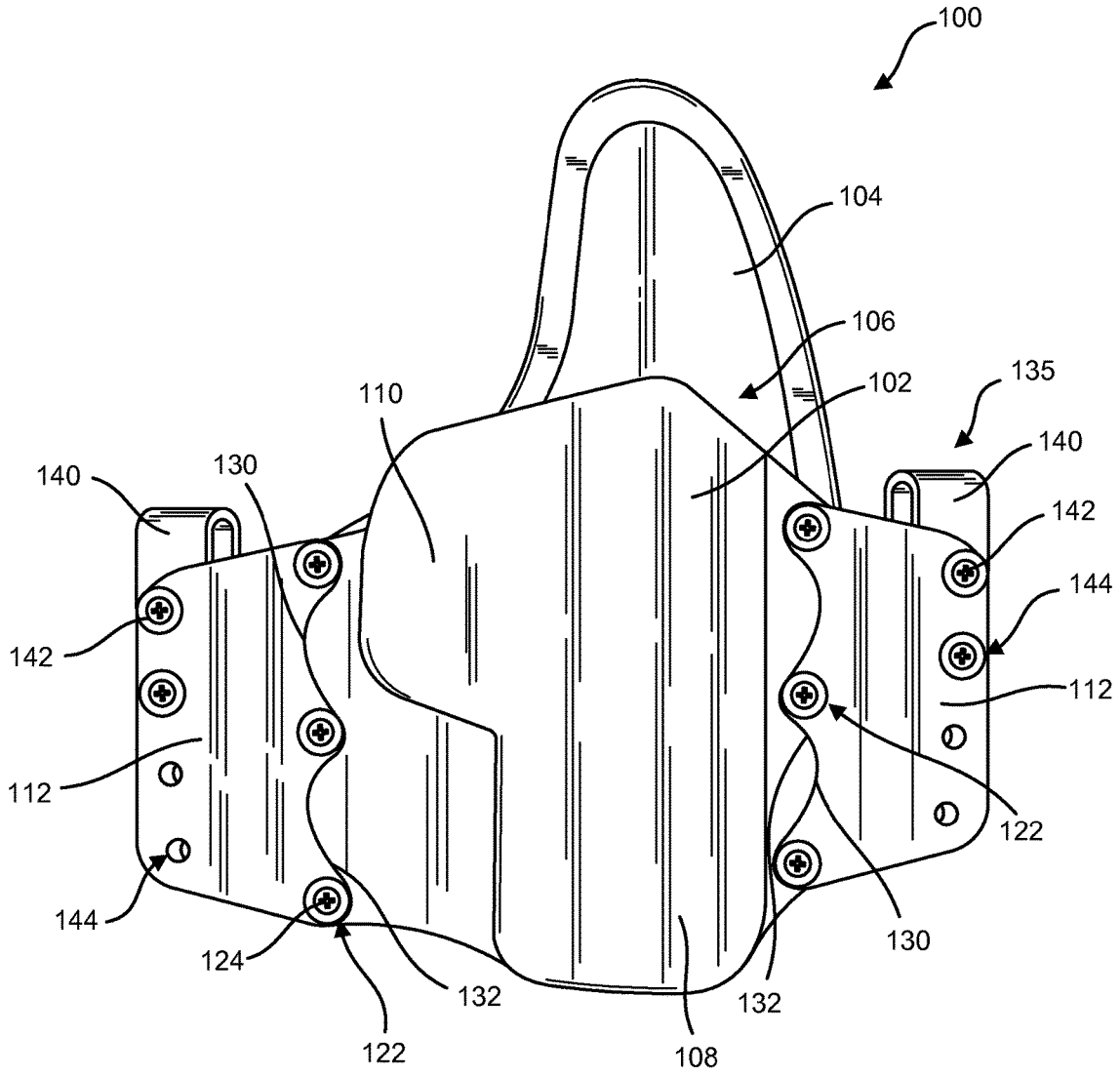
FIG. 2 shows a front view of the holster device of FIG. 1.

The shell 102 can be made out of a rigid material and can be shaped to conform to at least a part of a gun. For example, the shell 102 can include one or more indentations and/or features that are consistent with a shape of the gun, which can assist with securing the gun within the pocket 106. For example, the shell 102 can include a stepped-down feature or indentation that pushes the weapon toward the user's body when the weapon is secured within the pocket 106. As shown in FIGS. 1-2, for example, the shell 102 can include a barrel conforming section 108, which can be sized and shaped to conform to a barrel of the gun. In addition, the shell 102 can include a trigger conforming section 110, which can be sized and shaped to conform to a part of the gun that includes the trigger.

The conforming aspects of the shell 102 (e.g., trigger conforming section 110 and barrel conforming section 108) can assist with securing and stabilizing the gun within the pocket 106 as well as pushing the gun towards the user's body, which can assist in concealing the gun. In addition, the conforming aspects of the shell 102 can also assist with reducing an overall bulk of the holster device 100, which can also assist in concealing the weapon or gun. The shell 102 can have a variety of shapes and sizes, including having features that allow for fast weapon drawing from the holster device 100. For example, the shell 102 can include a notch or cutout that exposes a part of the weapon when the weapon is secured in the pocket 106. Any number of features can be included for assisting with increasing the speed at which the weapon can be drawn from the holster device 100. In addition, the shell 102 can be made out of a variety of materials, including a variety of light weight and rigid materials. For example, the shell 102 can be made out of Kydex, ballistic nylon, and/or leather. However, the shell 102 can be made out of other materials without departing from the scope of this disclosure.

In addition to the shell 102 conforming to a weapon, the holster device 100 can conform to a body part of the user and/or an article of clothing associated with the user. This can also assist with concealing the weapon as well as improving comfort and effectiveness associated with carrying the weapon. The ability of the holster device 100 to conform to the user will be described in greater detail below.

Figure 6:
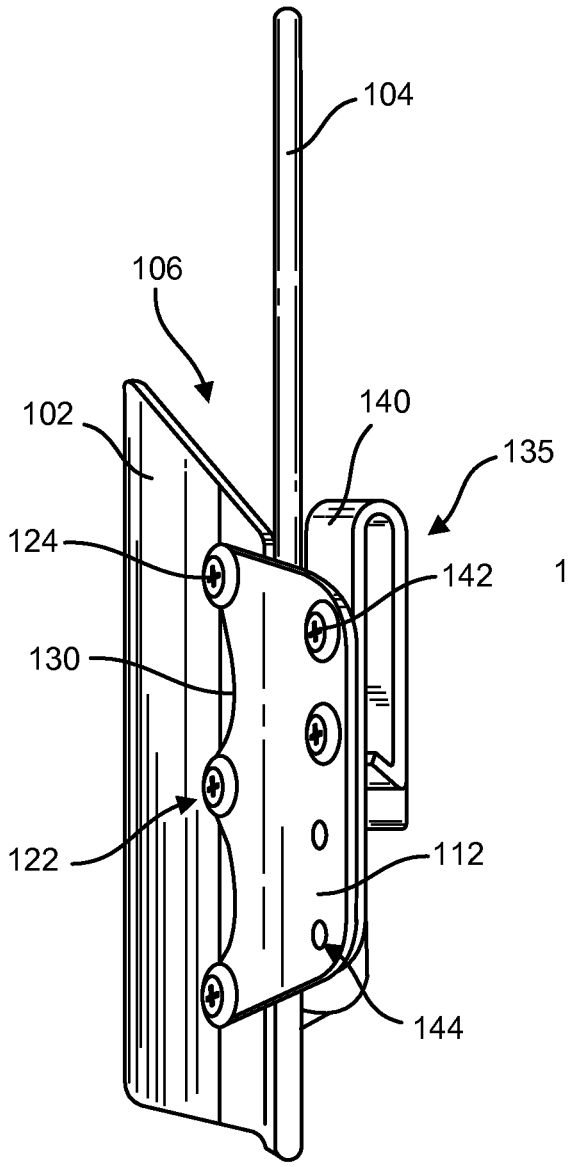
FIG. 6 shows a first side view of the holster device of FIG. 1.
Figure 7:
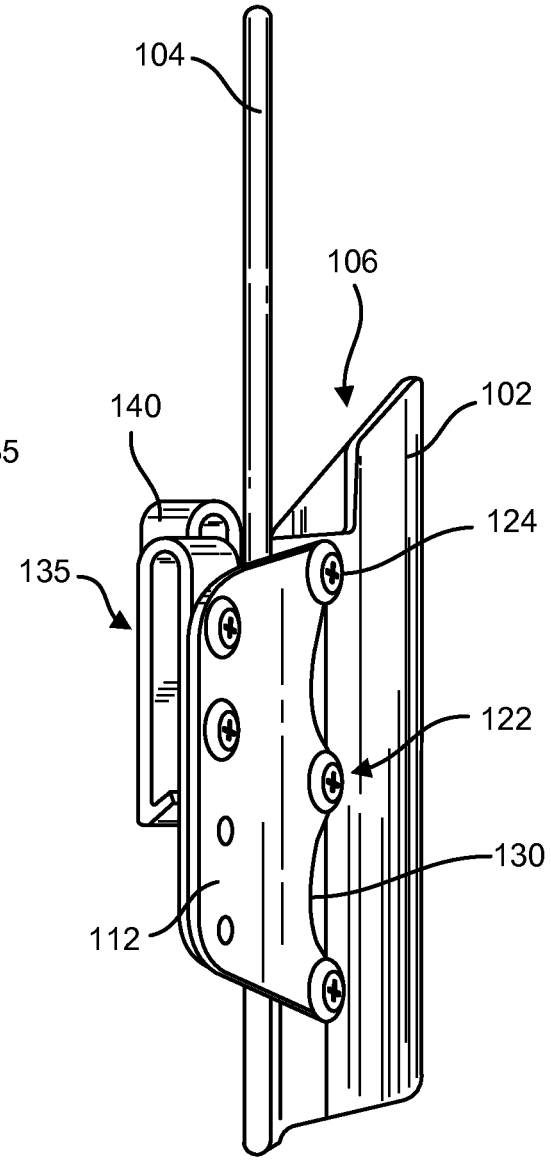
FIG. 7 shows a second side view of the holster device of FIG. 1.

For example, the holster device 100 can also include one or more wings 112 attached to the shell 102, such as a pair of wings 112 secured to opposing sides of the shell 102, as shown in FIGS. 1-2. The wings 112 can be sized and shaped to assist with allowing the holster device 100 to conform to the body part and/or article of clothing to which the holster device 100 is attached. For example, the wings 112 can be bent or angled such that they extend in a back direction (i.e., towards the body part and/or article of clothing to which the holster device is attached), as shown in FIGS. 6-7.

Figure 4:
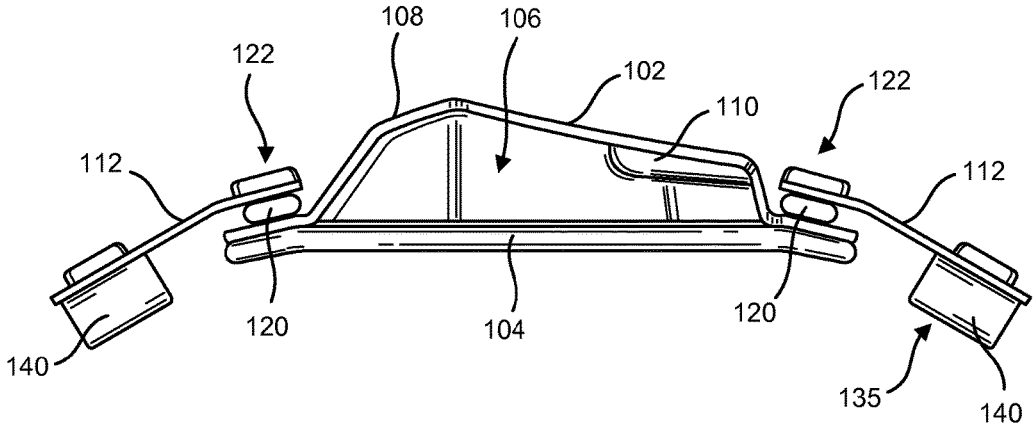
FIG. 4 shows a top view of the holster device of FIG. 1.
Figure 5:
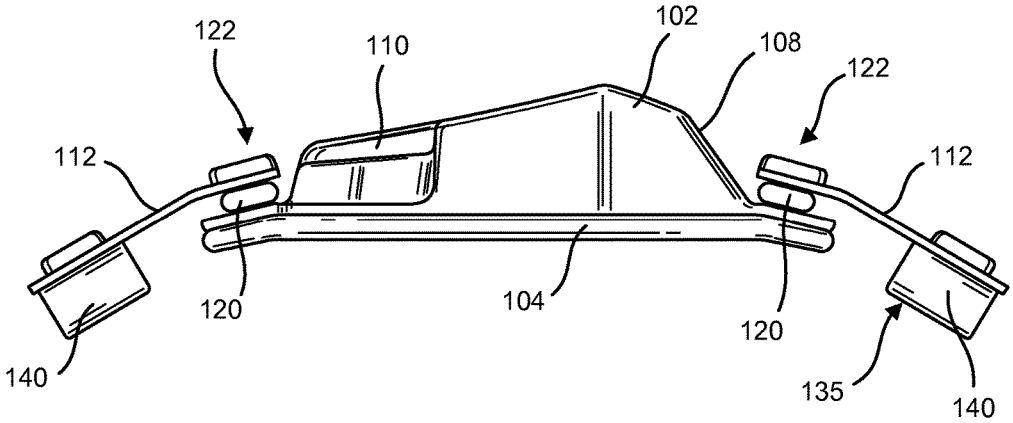
FIG. 5 shows a bottom view of the holster device of FIG. 1.

In addition, the holster device 100 can include one or more spacers 120 positioned between a wing 112 and the shell 102, as shown in FIG. 4-5. The spacers 120 can be made out of a flexible and/or compressible material that can allow the wing 112 adjacent the spacer 120 to flex relative to the shell 102. For example, the wing 112 can flex or bend towards the back direction, which can assist the holster device 100 with conforming to the body part and/or article of clothing to which the holster device 100 is attached. The spacers 120 can allow for improved flexibility and movement of the holster device 100, which can allow the holster device 100 to conform to a variety of shapes and sizes, such as a variety of body parts having a variety of circumferences (e.g., a leg, abdomen, arm, etc.). In addition, the flexibility and/or compressibility of the spacers 120 can allow the wings 112 to flex relative to the shell 102 in response to movement of the user, while still allowing the holster device 100 to remain secured to the user.

The size and shape of the spacers 120 can vary. For example, in some implementations, the spacers 120 can be substantially circular or oval in shape. In addition, the number of spacers 120 a holster device 100 includes can vary. For example, in some implementations, every attachment point 122 that connects the wing 112 to the shell 102 can include a spacer 120.

Figure 3:
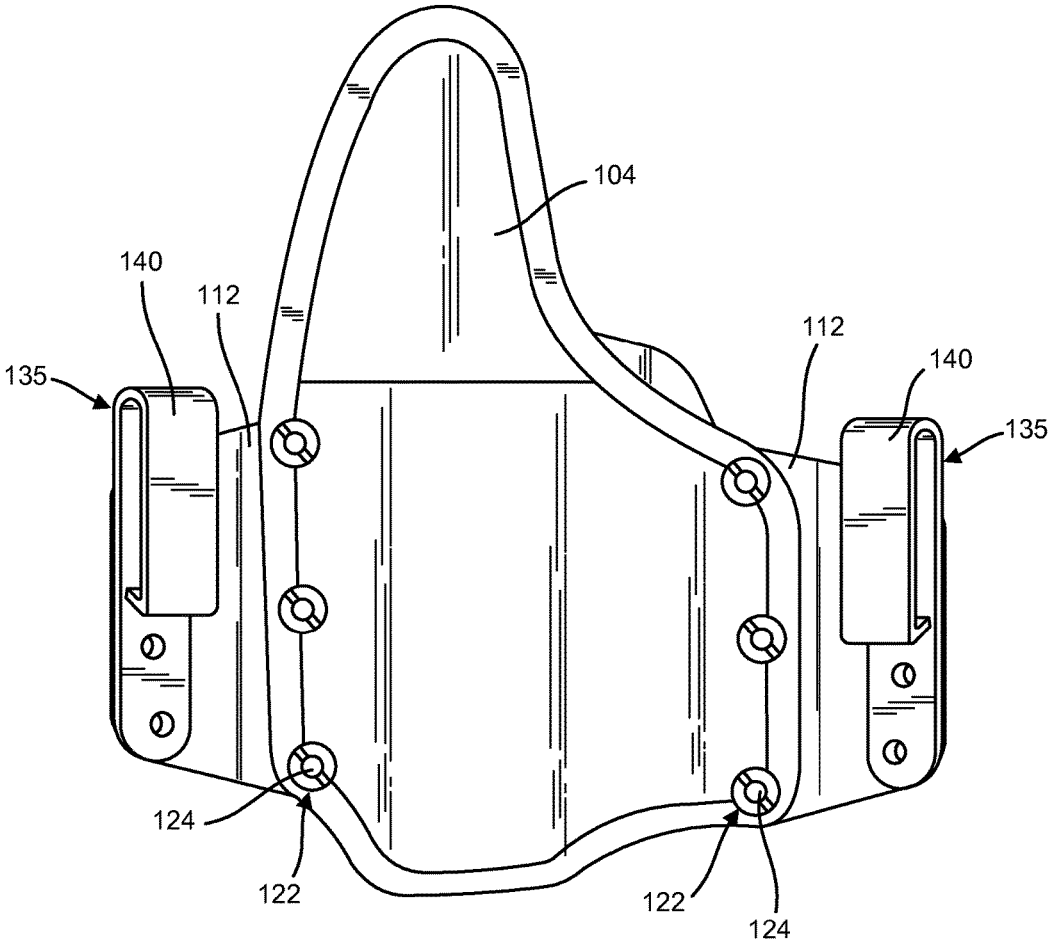
FIG. 3 shows a back view of the holster device of FIG. 1.

As shown in FIGS. 1-3, the attachment points 122 can include an attachment feature 124 (e.g., a rivet, a barrel nut and screw, etc.) that secures the wing 112, spacer 120, and shell 102 together. More specifically, the attachment feature 124 can secure the spacer 120 between the shell 102 and the wing 112. Although the spacer 120 is described as being separate from the attachment feature 124, the spacer 120 can include features that secure the wing 112 to the shell 102 such that an attachment feature is not needed. Furthermore, the attachment feature 124 (or spacer 120) can additionally secure the backing 104 to the shell 102. The attachment points 122 can also include attachment holes that allow the attachment feature 124 to extend therethrough. In addition, the attachment holes can be slotted in order to allow for additional flex of the wing 112 relative to the shell 102.

Figure 9:
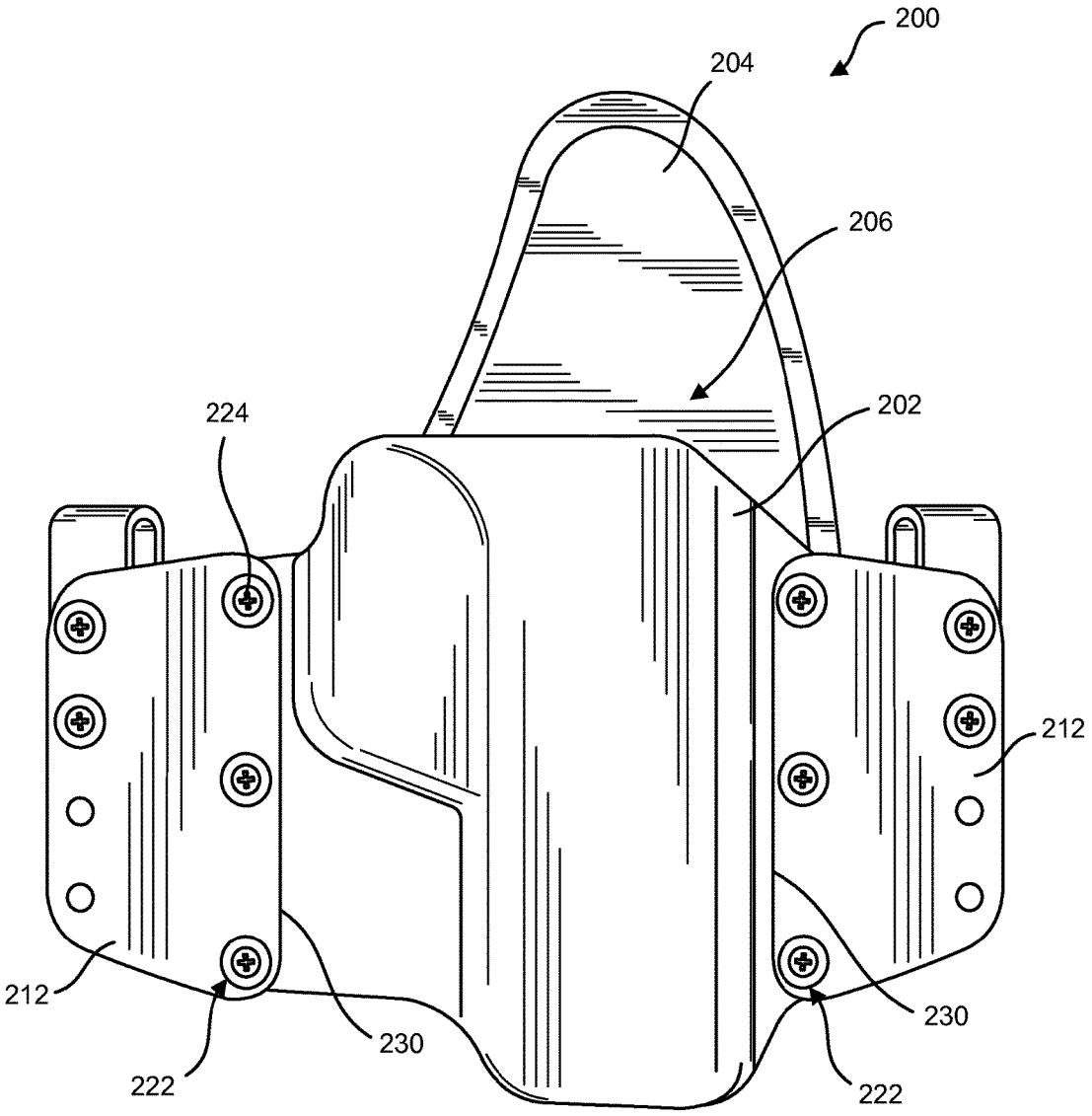
FIG. 9 shows a front view of the holster device of FIG. 8.

Although the holster device is shown and described herein as including two wings 112, the holster device 100 can include one or more wings 112 without departing from the scope of this disclosure. In addition, each wing 112 can have a variety of shapes and sizes. For example, the holster device 100 can include a first wing that has the same size and/or shape as a second wing. However, in some implementations, the first wing can have a different size and/or shape as the second wing. The first wing and second wing can also be positioned in a variety of ways relative to each other and the shell 102. For example, the first wing can be symmetrical with the second wing (as shown in FIG. 9), which can include a first top edge of the first wing aligning with a second top edge of the second wing. However, in some implementations, the first wing can be offset from the second sing (as shown in FIG. 2), which can include the top edge of the first wing being out of alignment with the second top edge of the second wing. In addition, the first and second wing can be made out of the same or different materials. Additionally, a wing 112 can be made out of either a flexible or rigid material.

As shown in FIG. 2, the wings 112 can include a coupling side 130 that can include one or more features that assist with allowing the wings 112 to flex relative to the shell 102. For example, the coupling side 130 can include one or more extensions 132, as shown in FIG. 2. In addition, the extensions 132 can include a location for the attachment point 122. As such, a spacer 120 can be positioned between an extension 132 of the wing 112 and the shell 102.

In some implementations, the holster device 100 can include a holster attachment feature 135, such as a clip 140. The holster attachment feature 135 can assist with securing the holster device 100 to a user, such as to an article of clothing or accessory associated with the user. For example, the clip 140 can releasably couple to a part of a belt or pants thereby releasably securing the holster device 100 to the part of the belt or pants. As shown in FIGS. 2-3, the clip 140 can be secured to a wing 122 of the holster device 100 using one or more clip attachment features 142. In addition, the wing 112 can include one or more clip attachment points 144 that allow the clip attachment feature 142 to securely attach the clip 140 to the wing 112. For example, the clip attachment points 144 of a wing 112 can allow a user to customize the position of the clip 140 relative to the wing 112, such as in order to adjust the height or angle of the weapon secured in the holster device 100 relative to where the holster device 100 is secured. Although the holster device 100 is shown as including a clip 140, any number of securing features for securing the holster device 100 to either a part of a body or article of clothing is within the scope of this disclosure.

In some implementations, the backing 104 of the holster device 100 can assist with securing the weapon within the pocket 106. The backing 104 can be shaped to extend a length along a side of the weapon that is secured within the pocket 106. The backing 104 have a variety of shapes and sizes, including a backing that does not extend the length of a weapon secured within the pocket 106. In addition, the backing 104 can be made out of a variety of materials and can include a variety of features, such as foam-padding and breathable material, which can provide added comfort for a user that is wearing the holster device 100. In some implementations, the backing 104 can be secured to the shell and extend a length such that it can provide a shield between the user wearing the holster device 100 and an entire upper portion of the weapon being secured in the pocket 106 of the holster device 100.

Figure 8:
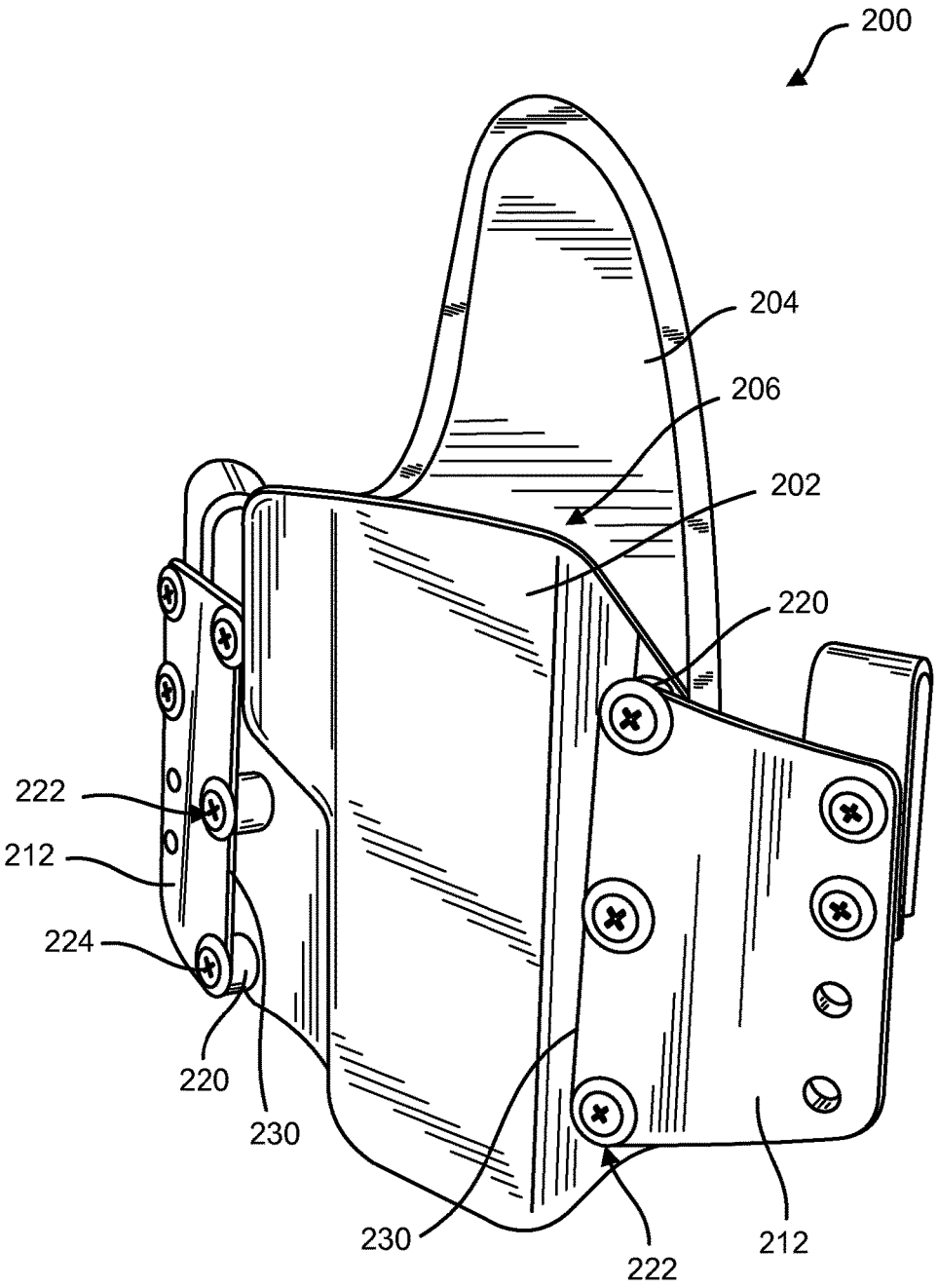
FIG. 8 shows a perspective view of another implementation of a holster device.

FIGS. 8-9 illustrate another implementation of the holster device 200, which can include a pair of symmetrical wings 212 that are coupled to opposing sides of a shell 202. In addition, the wings 212 can be aligned with each other such that the top sides of the wings are aligned. Additionally, the wings 212 of the holster device 200 can include a coupling side 230 that does not include features and, instead, is substantially flat or square. One or more attachment points 222 can be positioned adjacent the coupling side 230 and spacers 220 can be secured between the wing 212 and shell 202 at each attachment point 222, such as with an attachment feature 224. As discussed above, the spacers 220 can allow the wings 212 to flex relative to the shell 202, which can allow the holster device 200 to move and conform relative to a part of a user's body and/or article of clothing, which can improve concealment and comfort of the holster device 200.

Figure 10:
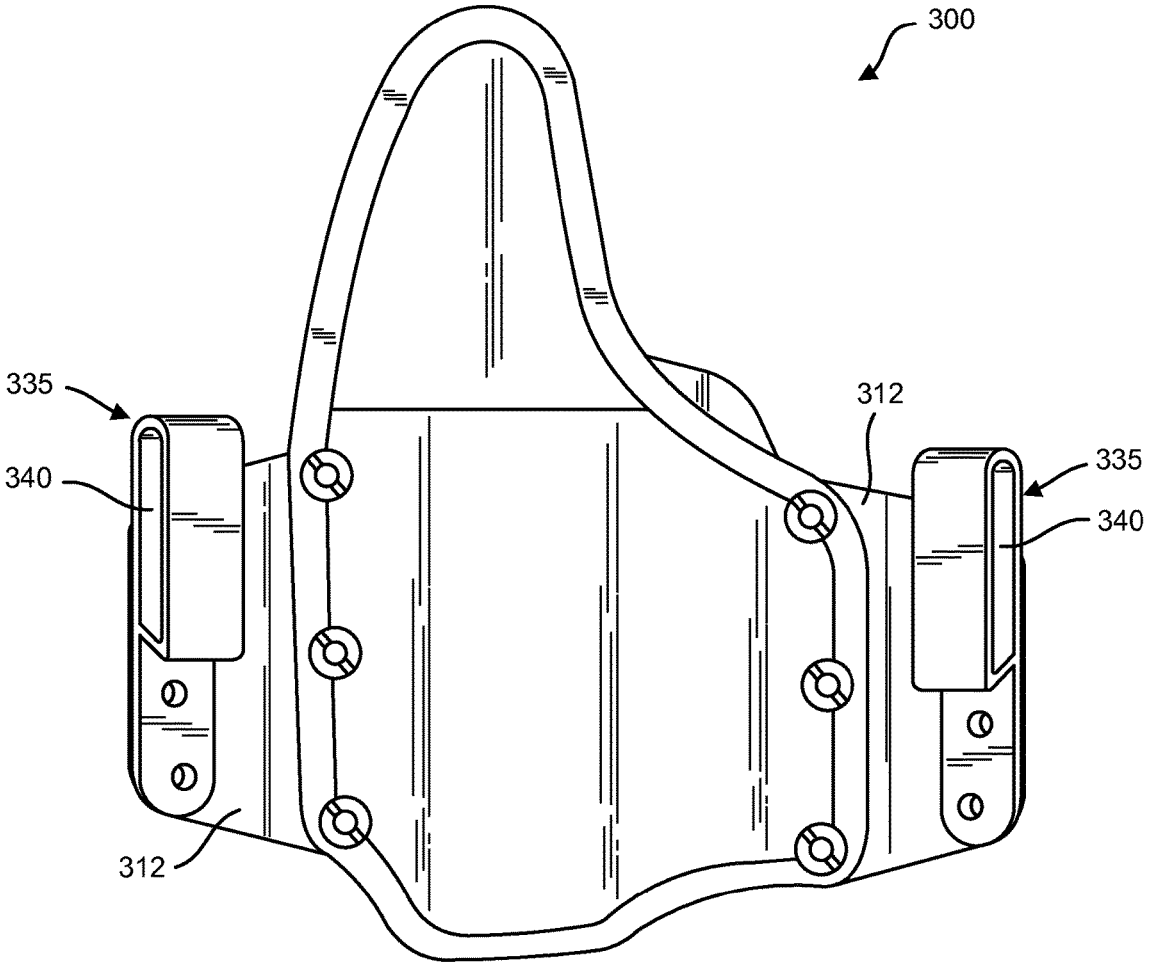
FIG. 10 shows a back view of another implementation of a holster device, which includes attachment features having a closed loop.

FIG. 10 shows a back view of another implementation of a holster device 300 that includes another implementation of a holster attachment feature 335 coupled to a wing 312 of the holster device 300. As shown in FIG. 10, the holster attachment feature 335 can include a closed loop 340 which can be sized and shaped to allow a belt (or other accessory) to extend therethrough, which can assist with securing the holster device 300 to a user. For example, a belt can be extended through the closed loops 340 that are secured to the wings 312 of the holster device 300. The belt can then be tightened and secured to the user, which can thereby secure the holster device 300 to the user. The closed loop 340 can include any of a variety of shapes and sizes, such as, for example, having one or more of a square shape, quadrilateral shape, circular shape, or oval shape. The closed loop 340 can also have a variety of thicknesses and features for effectively securing the closed loop 340, and thus the holster device 300, to a user.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described above can be directed to various combinations and sub-combinations of the disclosed features and/or combinations and sub-combinations of one or more features further to those disclosed herein. The scope of the following claims may include other implementations or embodiments.

What is claimed is:

1. A gun holster device comprising:

a shell that is shaped to cover a part of a first side of a gun, the shell having a front surface and a back surface;

a backing that is secured to the back surface of the shell thereby forming a pocket between the shell and the backing, the pocket being configured to secure the gun to the holster;

a first wing attached to and extending from a first end of the shell, the height of the first wing being at least two-thirds the height of the shell; and at least one spacer positioned between the first wing and the front surface of a first end of the shell, the at least one spacer comprising a flexible or compressible material that allows the first wing to flex relative to the shell.

2. The gun holster device of claim 1, wherein the shell comprises a rigid material.

3. The gun holster device of claim 1, wherein the backing is shaped to extend a length along a second side of the gun, with the second side being opposite the first side.

4. The gun holster device of claim 1, further comprising a second wing attached to and extending from a second end of the shell, with the first end and the second end being on opposite sides of the shell.

5. The gun holster device of claim 4, further comprising one or more spacers comprising a flexible or compressible material between the second wing and the second end of the shell that allows the second wing to flex relative to the shell.

6. The gun holster device of claim 4, wherein a first top edge of the first wing is aligned with a second top edge of the second wing.

7. The gun holster device of claim 4, wherein at least one of the first wing and the second wing comprises a rigid material.

8. The gun holster device of claim 1, further comprising a holster attachment feature configured to secure the gun holster device to at least one of a body part and an article of clothing.

9. The gun holster device of claim 8, wherein the holster attachment feature is releasably secured to the first wing such that a position of the holster attachment feature relative to the first wing is adjustable.

10. The gun holster device of claim 8, wherein the holster attachment feature comprises at least one of a clip and a closed loop.

11. The gun holster device of claim 1, wherein the backing comprises at least one of a padded material and a breathable material.

* * * * *